US010760823B2

(12) United States Patent
Knoblett et al.

(10) Patent No.: US 10,760,823 B2
(45) Date of Patent: Sep. 1, 2020

(54) HOT WATER STORAGE TANK WITH INTEGRATED PUMP AND CONTROLLER

(71) Applicant: Rinnai America Corporation, Peachtree City, GA (US)

(72) Inventors: Michael Scott Knoblett, Peachtree City, GA (US); Matthew Ryan Dettmering, Newnan, GA (US); Scott Gilman Humphrey, Newnan, GA (US)

(73) Assignee: Rinnai America Corporation, Peachtree City, GA (US)

( * ) Notice: Subject to any disclaimer, the term of this patent is extended or adjusted under 35 U.S.C. 154(b) by 70 days.

(21) Appl. No.: 16/148,697

(22) Filed: Oct. 1, 2018

(65) Prior Publication Data

US 2020/0103144 A1 Apr. 2, 2020

(51) Int. Cl.

| | |
|---|---|
| ***F24H 1/00*** | (2006.01) |
| ***F24H 9/20*** | (2006.01) |
| ***F24H 1/14*** | (2006.01) |
| ***F24H 1/18*** | (2006.01) |
| ***F24H 9/14*** | (2006.01) |

(Continued)

(52) U.S. Cl.

CPC ..... *F24H 9/2035* (2013.01); *F24D 17/0078* (2013.01); *F24H 1/145* (2013.01); *F24H 1/186* (2013.01); *F24H 9/124* (2013.01); *F24H 9/128* (2013.01); *F24H 9/142* (2013.01)

(58) Field of Classification Search

CPC ..... F22B 35/00; F22B 35/005; F22B 35/008; Y10T 137/0324; F24H 1/00

See application file for complete search history.

(56) References Cited

U.S. PATENT DOCUMENTS 5,193,138 A * 3/1993 Richey ..... F24D 11/002 165/104.19

5,205,318 A * 4/1993 Massaro ..... F24D 17/0078 122/13.3

(Continued)

OTHER PUBLICATIONS

Rinnai, Commercial Hybrid System Installation and Operation Manual. Mar. 2017, 34 pages.

(Continued)

*Primary Examiner* — Gregory A Wilson

(74) *Attorney, Agent, or Firm* — Meunier Carlin & Curfman LLC

(57) ABSTRACT

A hot water supply system decouples an intelligent hot water storage system from a water heating engine system. The water heating engine system includes a plurality of instantaneous water heaters that provide for redundant operation for improved reliability. The intelligent hot water storage system includes a storage tank that encloses a volume for storage of water. The intelligent hot water storage system includes a recirculation loop driven by an integrated pump and operated by an integrated controller. By positioning the tank recirculation outlet and inlet farther apart from each other, additional usable volume of hot water is provided by the intelligent hot water storage system. Isolation valves positioned on the input and output of a recirculation pump in the recirculation loop facilitate repair or replacement of the recirculation pump. The hot water system provides for increased capacity while providing redundant heating engines in a smaller floor space than conventional systems.

19 Claims, 6 Drawing Sheets

(51) Int. Cl.
*F24H 9/12* (2006.01)
*F24D 17/00* (2006.01)

(56) References Cited

U.S. PATENT DOCUMENTS

| | | | | |
|---|---|---|---|---|
| 8,437,626 | B2 | 5/2013 | Ding et al. | |
| 8,498,523 | B2 | 7/2013 | Deivasigamani et al. | |
| 9,335,066 | B2 | 5/2016 | Humphrey et al. | |
| 9,909,780 | B2 | 3/2018 | Humphrey et al. | |
| 10,330,344 | B2 * | 6/2019 | Teng | F24H 9/2007 |
| 10,352,587 | B2 * | 7/2019 | Shaffer | F24H 4/04 |
| 2008/0152331 | A1 | 6/2008 | Ryks | |
| 2018/0209692 | A1 * | 7/2018 | Shaffer, Jr. | F24H 1/201 |
| 2019/0041092 | A1 * | 2/2019 | Niu | F24H 9/126 |
| 2019/0293303 | A1 * | 9/2019 | Zhang | F24D 19/106 |

OTHER PUBLICATIONS

Rinnai, Commercial Water Heating Solutions for Dealers and Installers. May 2018, 21 pages.

* cited by examiner

HOT WATER STORAGE TANK WITH INTEGRATED PUMP AND CONTROLLER

BACKGROUND

The need for heated fluids, and in particular heated water, has long been recognized. Conventionally, water has been heated by heating elements, either electrically or with gas burners, while stored in a tank or reservoir. While effective, energy efficiency and water conservation using a storage tank alone can be poor. As an example, water that is stored in a hot water storage tank is maintained at a desired temperature at all times. Thus, unless the storage tank is well insulated, heat loss through radiation can occur, requiring additional input of energy to maintain the desired temperature. In effect, continual heating of the stored water in the storage tank is required.

Many of the problems with traditional hot water storage tanks have been overcome by the use of tankless water heaters. With the tankless water heater, incoming ground water passes through a component generally known as a heat exchanger and is instantaneously heated by heating elements (or gas burner) within the heat exchanger until the temperature of the water leaving the heat exchanger matches a desired temperature set by a user of the system. With such systems the heat exchanger is typically heated by a large current flow (or Gas/BTU input) which is regulated by an electronic control system. The electronic control system also typically includes a temperature selection device, such as a thermostat, by which the user of the system can select the desired temperature of the water being output from the heat exchanger.

SUMMARY

A first aspect of the disclosure provides a hot water storage system. The hot water storage system comprises a storage tank with a top surface, a bottom surface, and a sidewall that extends between the top surface and the bottom surface, the storage tank encloses a volume. The hot water storage system comprises a tank cold water inlet, a tank recirculation outlet positioned on the sidewall above the tank cold water inlet, a tank recirculation inlet positioned on the sidewall above the tank recirculation outlet, and a storage system recirculation outlet. The hot water storage system comprises a recirculation pump positioned between the tank recirculation outlet and the storage system recirculation outlet, the recirculation pump comprising a pump inlet and a pump outlet. The hot water storage system comprises an inlet isolation valve positioned between the tank recirculation outlet and the pump inlet, wherein the pump inlet is in fluid communication with the tank recirculation outlet when the inlet isolation valve is open, and wherein the pump inlet is fluidically isolated from the tank recirculation outlet when the inlet isolation valve is closed.

In some implementations of the first aspect of the disclosure, the hot water storage system further comprises an outlet isolation valve positioned between the pump outlet and the storage system recirculation outlet. The storage system recirculation outlet is in fluid communication with the pump outlet when the outlet isolation valve is open. The storage system outlet is fluidically isolated from the pump outlet when the outlet isolation valve is closed.

In some implementations of the first aspect of the disclosure, the cold-water inlet is positioned on the sidewall about the bottom surface.

In some implementations of the first aspect of the disclosure, the hot water storage system further comprises a tank hot water outlet positioned on the top surface and a storage system hot water outlet. The hot water storage system further comprises a second outlet isolation valve positioned between the tank hot water outlet and the storage system hot water outlet. The storage system hot water outlet is in fluid communication with the tank hot water outlet when the second outlet isolation valve is open. The storage system hot water outlet is fluidically isolated from the tank hot water outlet when the second outlet isolation valve is closed.

In some implementations of the first aspect of the disclosure, the hot water storage system further comprises a storage system recirculation inlet. The hot water storage system further comprises a second inlet isolation valve positioned between the storage system recirculation inlet and the storage system hot water outlet. The storage system hot water outlet is in fluid communication with the storage system recirculation inlet when the second inlet isolation valve is open. The storage system hot water outlet is fluidically isolated from the storage system recirculation inlet when the second inlet isolation valve is closed.

In some implementations of the first aspect of the disclosure, the hot water storage system further comprises a third inlet isolation valve positioned between the storage system recirculation inlet and the tank recirculation inlet. The tank recirculation inlet is in fluid communication with the storage system recirculation inlet when the third inlet isolation valve is open. The storage system hot water outlet is fluidically isolated from the storage system recirculation inlet when the outlet isolation valve is closed.

In some implementations of the first aspect of the disclosure, the hot water storage system further comprises a temperature sensor positioned within the volume about the recirculation water outlet. The hot water storage system further comprises a controller in communication with the temperature sensor and configured to receive a first input of a temperature from the temperature sensor. The controller further configured to receive a second input of a set point, wherein the controller is configured to activate the recirculation pump based on the set point and the temperature.

In some implementations of the first aspect of the disclosure, the second input is a communication of the set point received from an external control system.

In some implementations of the first aspect of the disclosure, the hot water storage system further comprises a second temperature sensor configured to measure a temperature of hot water supplied to the recirculation water inlet. The second input is the temperature from the second temperature sensor.

In some implementations of the first aspect of the disclosure, the tank recirculation inlet positioned along the sidewall at or above at least at 80% of the volume from the bottom surface.

In some implementations of the first aspect of the disclosure, the tank recirculation outlet is positioned along the sidewall at or below at least 20% of the volume from the bottom surface.

A second aspect of the disclosure provides a hot water supply system. The hot water supply system comprises a plurality of hot water heaters, each comprising a heater inlet and a heater outlet, wherein the heater inlet is coupled to an inlet manifold and the heater outlet is coupled to an outlet manifold. The hot water supply system comprises a storage tank with a top surface, a bottom surface, and a sidewall that extends between the top surface and the bottom surface, the storage tank encloses a volume. The hot water supply system comprises a tank recirculation outlet positioned on the sidewall and a recirculation pump positioned between the tank recirculation outlet and the inlet manifold. The hot water supply system comprises a tank recirculation inlet positioned on the sidewall above the tank recirculation outlet and coupled to the outlet manifold.

In some implementations of the second aspect of the disclosure, the plurality of hot water heaters are tankless water heaters.

In some implementations of the second aspect of the disclosure, each of the plurality of tankless water heaters has an input of less than 200,000 BTU/hr.

In some implementations of the second aspect of the disclosure, the storage tank has a capacity of 119 gallons.

In some implementations of the second aspect of the disclosure, a floor space coverage of less than 16.38 square feet.

In some implementations of the second aspect of the disclosure, a total volume of the hot water supply system is less than 103.9 cubic feet.

In some implementations of the second aspect of the disclosure, the hot water supply system further comprises a second storage tank with a second top surface, a second bottom surface, and a second sidewall that extends between the second top surface and the second bottom surface, the second storage tank encloses a second volume. The hot water supply system comprises a second tank recirculation outlet positioned on the second sidewall. The hot water supply system comprises a tank recirculation outlet manifold coupled to the tank recirculation outlet and the second tank recirculation outlet. The tank recirculation outlet manifold is further coupled to the inlet manifold.

In some implementations of the second aspect of the disclosure, the hot water supply system further comprises a second tank recirculation inlet positioned on the second sidewall above the second tank recirculation outlet. The hot water supply system comprises a tank recirculation inlet manifold coupled to the tank recirculation inlet and the second tank recirculation inlet. The tank recirculation inlet manifold is further coupled to the outlet manifold.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
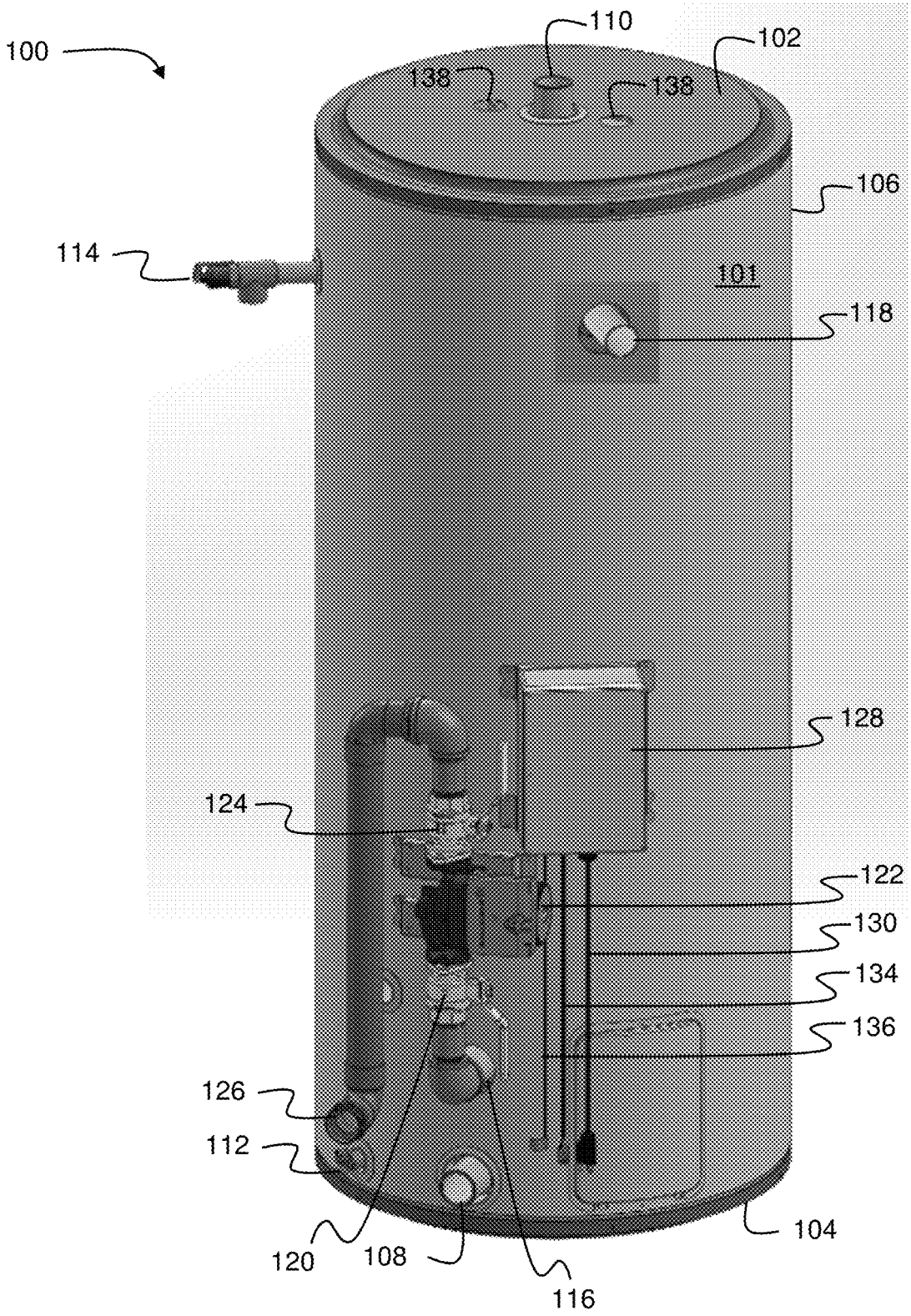
FIG. 1 illustrates a hot water storage system suitable for implementing the several embodiments of the disclosure.

It should be understood at the outset that although illustrative implementations of one or more embodiments are illustrated below, the disclosed systems and methods may be implemented using any number of techniques, whether currently known or in existence. Like numbers represent like parts throughout the various figures, the description of which is not repeated for each figure. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

Hybrid water heating systems that comprise an instantaneous water heater mounted onto a water container provide for improved heating capacity for supplying hot water longer and higher first hour ratings. For example, commonly owned U.S. Pat. No. 9,335,066, entitled "Water Heating System," hereby incorporated by reference in its entirety, discloses an example of such an improved hybrid water heating system. However, mounting the instantaneous water heater to the water container limits the total capacity of the system for higher draw rate applications.

To accommodate scaling to higher capacities, particularly for commercial applications, a hot water supply system is provided that decouples an intelligent hot water storage system from a water heating engine system. In other words, the intelligent hot water storage system does not include a heating element. Accordingly, different water heating engine systems can be scaled and sized to meet a variety of different capacity requirements for supplying hot water to the intelligent hot water system through a recirculation circuit. In various implementations, the water heating engine system includes a plurality of independent heating engines. Each of the plurality of independent heating engines may be an instantaneous water heater with an input of less than 200,000 BTU/hr. By providing multiple independent heating engines, the hot water supply system is provided with redundancy to continue supplying hot water even if one or more of the heating engines fails or otherwise requires maintenance.

The intelligent hot water storage system includes a storage tank with a top surface, a bottom surface, and a sidewall that extends between the top surface and the bottom surface that encloses a volume for storage of water or other fluids therein. The enclosed storage volume is greater than comparably sized hot water systems with integrated heating elements due to not requiring space for accommodating heating elements or a flu. For example, with a 119-gallon storage tank, all 119 gallons may be utilized for storage of water therein. The storage tank includes a cold-water inlet positioned on the sidewall adjacent to the bottom surface and a hot water outlet positioned on the top surface.

The intelligent hot water storage system includes a recirculation loop driven by an integrated pump and operated by an integrated controller. The recirculation loop includes a tank recirculation outlet positioned on the sidewall above the cold-water inlet. The recirculation loop also includes a tank recirculation inlet positioned on the sidewall above the tank recirculation outlet towards the top surface. The tank recirculation outlet is positioned on the sidewall at or below at least 20% of the volume of the tank or a length of the sidewall from the bottom surface. Likewise, the tank recirculation inlet is positioned on the sidewall at or above at least 80% of the volume of the tank or a length of the sidewall from the bottom surface. By positioning the tank recirculation outlet and inlet farther apart from each other on the sidewall, temperature stratification between cold water on a bottom of the tank and hot water stored within the tank is improved. Accordingly, a usable volume of hot water (e.g. hot water within 20° F. of the set point) stored within the tank is increased to be approximately 90% of the storage volume of the tank.

The tank recirculation outlet is fluidically coupled to a pump inlet of a recirculation pump via an inlet isolation valve. Likewise, a pump outlet of the recirculation pump is fluidically coupled to an outlet isolation valve. For example, the inlet and outlet isolation valves may be a ball valve, solenoid valve, or any other type of shut-off valve configured to fluidically isolate the pump inlet or pump outlet. Accordingly, the inlet and outlet isolation valves facilitate repair or replacement of the recirculation pump.

Taken together, the above features of the hot water supply system provide for a larger capacity hot water system with redundant heating engines in a smaller footprint and overall volume of space than conventional redundant high capacity water heating systems. For example, an implementation of the hot water supply system may include a 119-gallon intelligent hot water storage system with a 15 GPM recirculation pump. The intelligent hot water storage system is fluidically coupled via the recirculation loop to a water heating engine system with two instantaneous water heaters with an input less than 200,000 BTU/hr. In some implementations, the input is greater than 190,000 BTU/hr. In this exemplary implementation, the hot water system occupies a square footage of less than 16.38 square feet and a total system volume of less than 103.9 cubic feet. For example, the hot water system occupies a square footage of about 11.13 square feet and a total system volume of about 64.5 cubic feet. Accordingly, the hot water system provides for increased capacity while providing redundant heating engines in a smaller floor space than conventional systems.

FIG. 1 illustrates a hot water storage system 100 suitable for implementing the several embodiments of the disclosure. The hot water storage system 100 includes a storage tank 101 with a top surface 102, a base or bottom surface 104, and a sidewall 106 that extends between the top surface 102 and the bottom surface 104. The bottom surface 104 is a surface upon which the storage tank 101 rests on a substrate or floor in use. The top surface 102 is a surface on an opposing end of the storage tank 101 as the bottom surface 104.

The storage tank 101 encloses a volume for storage of water or other fluids therein. The enclosed storage volume is greater than comparably sized hot water systems with integrated heating elements due to not requiring space for accommodating heating elements or a flu. For example, with a 119-gallon storage tank, all 119 gallons may be utilized for storage of water therein.

The storage tank 101 includes a cold-water inlet 108 positioned on the sidewall 106 adjacent to the bottom surface 104 and a hot water outlet 110 positioned on the top surface 102. In use, the cold-water inlet 108 is coupled to a municipal water supply or other water supply for supplying cold water to the storage volume of the storage tank 101. The storage tank 101 also includes a drain 112 positioned on the sidewall 106 adjacent to the bottom surface 104 at about the same distance from the bottom surface 104 as the cold-water inlet 108. The drain includes a drain plug (not shown) or other access port for draining water from the storage volume of the storage tank 101. In other words, the cold-water inlet 108 is positioned at the same distance between the top surface 102 and the bottom surface 104 as the drain 112. The storage tank 101 also includes a pressure relief valve 114 configured to relieve overpressure from within the storage tank 101. The storage tank 101 also includes one or more sacrificial anodes 138.

The hot water storage system 100 includes a recirculation loop with a tank recirculation outlet 116 positioned on the sidewall 106 above the cold-water inlet 108. The recirculation loop also includes a tank recirculation inlet 118 positioned on the sidewall 106 above the tank recirculation outlet 116 towards the top surface 102. The tank recirculation inlet 118 is positioned on the sidewall 106 at about the same distance from the top surface 102 as the pressure relieve valve. The tank recirculation inlet 118 is closer to the top surface 102 than to the tank recirculation outlet 116. As discussed in more detail below, the tank recirculation inlet 118 is configured to receive hot water from an external water heating engine system. Because the hot water storage system 100 is configured to receive hot water from an external system, various implementations of the hot water storage system 100 do not include a heating element.

In various implementations, the tank recirculation outlet 116 is positioned on the sidewall at or below at least 20% of the volume of the tank or a length of the sidewall 106 from the bottom surface 104. For example, the tank recirculation outlet 116 is positioned on the sidewall 106 at or below 20%, 19%, 18%, 17%, 16%, or 15% of the volume of the tank 101 or the length of the sidewall 106 from the bottom surface 104. Likewise, the tank recirculation inlet 118 is positioned on the sidewall 106 at or above at least 80% of the volume of the tank 101 or a length of the sidewall 106 from the bottom surface 104. For example, the tank recirculation inlet 118 is positioned on the sidewall at or above 80%, 85%, 86%, 87%, 88%, 89% or 90% of the volume of the tank 101 or the length of the sidewall 106 from the bottom surface 104. In an exemplary implementation, the tank recirculation outlet 116 is positioned on the sidewall 106 at or below 16% of the volume of the tank 101 or the length of the sidewall 106 from the bottom surface 104 and the tank recirculation inlet 118 is positioned at or above 89% of the volume of the tank 101 or the length of the sidewall 106 from the bottom surface 104.

By positioning the tank recirculation outlet 116 and inlet 118 farther apart from each other on the sidewall 106, temperature stratification between cold water on a bottom of the tank 101 and hot water stored within the tank 101 is improved. Accordingly, a usable volume of hot water stored within the tank is increased to be approximately 90% of the storage volume of the tank. Following the example above of a 119-gallon storage tank 101, this provides for a usable hot water storage volume of approximately 107 gallons. The usable hot water storage volume is a volume of hot water stored within the storage tank 101 within a threshold temperature difference of the set point. In some implementations, the threshold temperature difference is within 20° F. of the set point. Other threshold temperature difference values may be used and may be defined as a relative amount with respect to the set point. For example, the threshold temperature difference may be within 15% of the temperature of the set point.

The recirculation loop of the hot water storage system 100 also includes an inlet isolation valve 120, a recirculation pump 122, an outlet isolation valve 124, and a storage system recirculation outlet 126. The tank recirculation outlet 116 is fluidically coupled to a pump inlet of the recirculation pump 122 via the inlet isolation valve 120. One or more lengths of pipe may fluidically connect the tank recirculation outlet 116 to the inlet isolation valve 120. In the example shown in FIG. 1, the recirculation pump 122 is oriented with the pump inlet facing in a direction towards a plane parallel to and coincident with a plane of the bottom surface 104. Likewise, a pump outlet of the recirculation pump 122 faces in a direction towards a plane parallel to and coincident with a plane of the top surface 102. Other orientations of the recirculation pump 122 are contemplated, such as at an orientation perpendicular to that shown in FIG. 1 or at any angle therebetween.

The inlet isolation valve 120 is configurable between an open and closed position. In the closed position, the inlet isolation valve 120 is configured to fluidically isolate the pump inlet of the recirculation pump 122 from the tank recirculation outlet 116. In the open position of the inlet isolation valve 120, the pump inlet of the recirculation pump 122 is in fluid communication with the tank recirculation outlet 116.

The pump outlet of the recirculation pump 122 is fluidically coupled to the storage system recirculation outlet 126 via the outlet isolation valve 124. The outlet isolation valve 124 is configurable between an open and closed position. In the closed position, the outlet isolation valve 124 is configured to fluidically isolate the pump outlet of the recirculation pump 122 from the storage system recirculation outlet 126. In the open position of the outlet isolation valve 124, the pump outlet of the recirculation pump 122 is in fluid communication with the storage system recirculation outlet 126.

The inlet and outlet isolation valves 120, 124 may be implemented as any type of valve configured to fluidically isolate the recirculation pump 122 as described above. For example, the inlet and outlet isolation valves 120, 124 may be implemented as a ball valve, solenoid valve, or any other type of shut-off valve configured to selectively allow fluid flow through the recirculation pump 122 in one position and fluidically isolate the recirculation pump 122 in another position.

With the inlet and outlet isolation valves 120, 124 in the open position, the recirculation pump 122 is configured to draw water from within the storage volume of the storage tank 101 through the tank recirculation outlet 116. The recirculation pump 122 is configured to pump the drawn water from the pump outlet in a direction of flow toward the storage system recirculation outlet 126. As described in more detail below, the recirculation pump 122 provides the motive force for circulating fluids from the storage system recirculation outlet 126, through the external water heating engine system, and back into the storage volume of the storage tank 101 through the tank recirculation inlet 118.

Selectively isolating the recirculation pump 122 from the tank recirculation outlet 116 and/or the storage system recirculation outlet 126 facilitates repair or replacement of the recirculation pump 122 without requiring draining the hot water storage system 100. Additionally, selectively isolating the recirculation pump 122 facilitates repair or replacement of the recirculation pump 122 without requiring replacement of the storage tank 101 or any components of the external water heating engine system. Accordingly, the inlet and outlet isolation valves 120, 124 facilitate field replacement of the recirculation pump 122.

The hot water storage system 100 also includes an integrated control block 128 for controlling operation of the recirculation pump 122. The control block 128 includes a power input 130, such as a standard three prong outlet plug for receiving power from a 120 V AC power outlet. The control block 128 includes an input from a temperature sensor 142 for receiving a temperature sensor measurement from a temperature sensor within the storage volume of the storage tank 101. For example, the temperature sensor may be positioned proximate to the tank recirculation outlet 116. The control block 128 also includes a set point input 136 for receiving a set point of the external water heating engine system. For example, the set point input 136 may be a thermistor or other temperature sensor positioned at an outlet of the external water heating engine system for measuring a temperature of the hot water produced by the external water heating engine system. In another implementation, the set point input 136 may be a wired or wireless communication system for electronically receiving the set point from a controller of the external water heating engine system. The control block 128 also includes a pump voltage output 134 for powering the recirculation pump 122 and causing the recirculation pump 122 to operate. The pump voltage output 134 is electrically coupled to the recirculation pump 122. The control block 128 also includes a controller 140 for selectively supplying voltage to the recirculation pump 122 through the pump voltage output 134. Operation of the controller 140 in the control block 128 is described in more detail below with reference to FIG. 4.

In the example provided above with reference to FIG. 1, the terms above or higher indicate a location along the sidewall 106 closer to the top surface 102 in a direction from the bottom surface 104 to the top surface 102. Likewise, the terms below or lower indicate a location along the sidewall 106 closer to the bottom surface 104 in a direction from the top surface 102 to the bottom surface 104. The terms inlet and outlet used in conjunction with the inlets and outlets 108, 110, 116, 118 indicate a spud, port, or fixture on the storage tank 101 for providing access to the storage volume from outside of the storage tank 101 and for attaching or otherwise affixing plumbing.

While an example of the hot water storage system 100 is described above with reference to FIG. 1 may variations are contemplated without departing from the spirit and scope of this disclosure. For example, as noted above, the orientation of the recirculation pump 122 may be other than that shown. Additionally, one or more of the inlet and outlet isolation valves 120, 124 may be omitted in various implementations.

Figure 2:
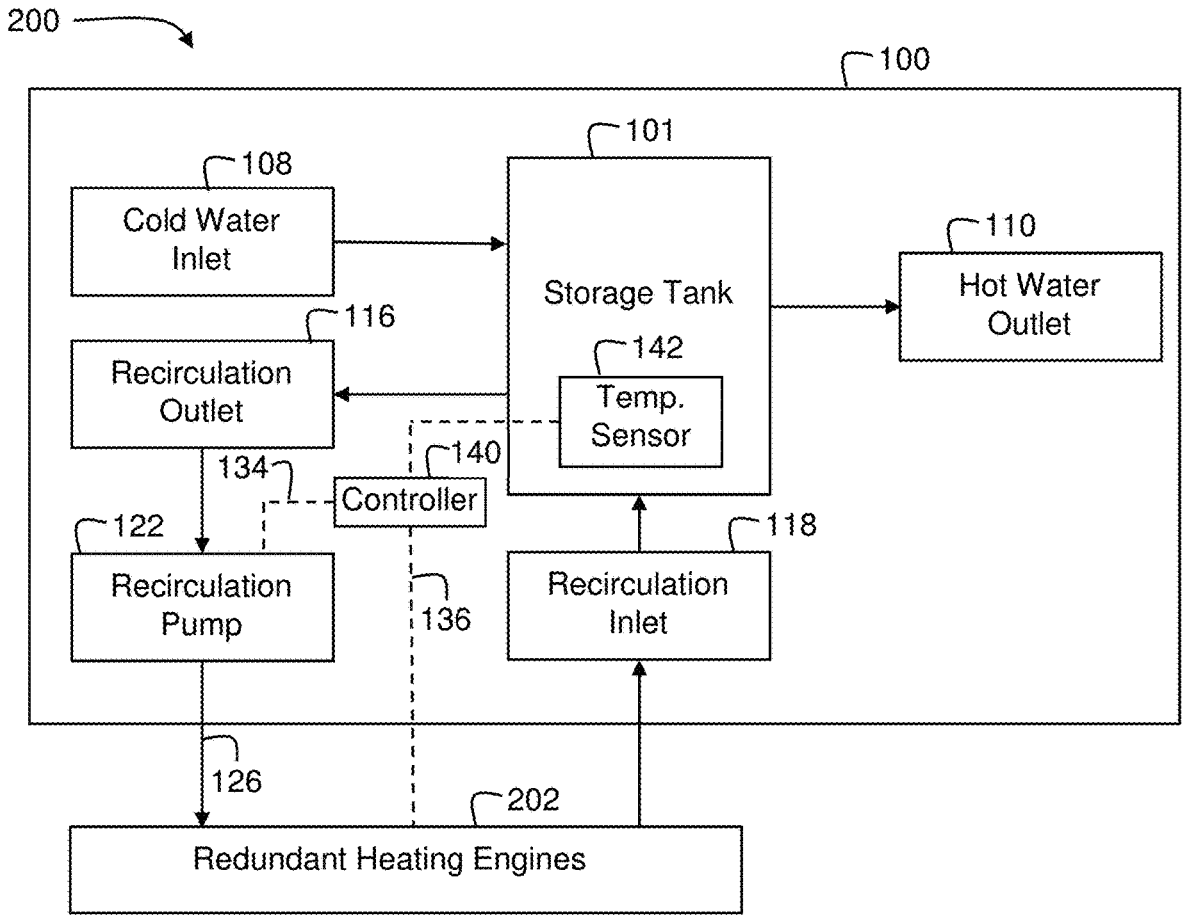
FIG. 2 illustrates a hot water supply system comprising the hot water storage system of FIG. 1.

FIG. 2 illustrates a hot water supply system 200 that comprises the hot water storage system 100 of FIG. 1 and an external water heating engine system 202. The external water heating engine system 202 comprises a plurality of heating engines. As hot water storage volume is provided by the storage tank 101, the plurality of heating engines are implemented as tankless water heaters. Throughout this disclosure, tankless, demand-type, on-demand, or instantaneous water heaters are used synonymously with each other and refer to systems that heat water as the water flows through the water heater. While some amount of volume or storage of water may be present on such systems, the size of such storage may be limited to about one gallon of water or less. Additionally, these water heaters typically do not maintain the temperature of water within the water heater when not in use. Each of the tankless water heaters have an input of less than 200,000 BTU/hr. In some implementations, the tankless water heaters may have an input of greater than 190,000 BTU/hr.

Providing a plurality of heating engines in the external water heating engine system 202 enables the hot water supply system 200 to be scaled and sized to meet a variety of different capacity requirements for supplying hot water. Each of the plurality of heating engines may be an independent system with its own controller for supplying hot water at a set point temperature. In some implementations, the controllers of the heating engines may be chained together (e.g., master-slave, etc.) or otherwise communicate with one another to allow for adjustment of the set point temperature on any of the heating engines. By providing multiple independent heating engines, the hot water supply system is provided with redundancy to continue supplying hot water even if one or more of the heating engines fails or otherwise requires maintenance.

Figure 3:
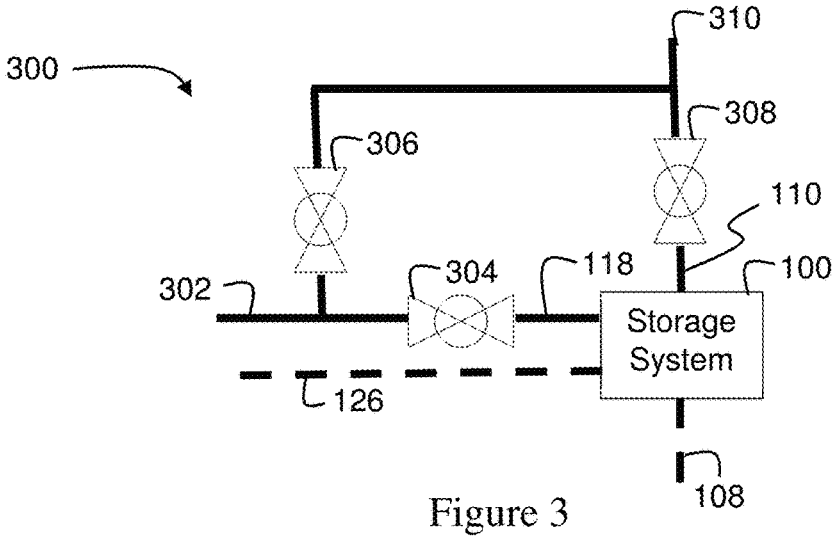
FIG. 3 illustrates a bypass circuit in the hot water storage system suitable for implementing the several embodiments of the disclosure.

FIG. 3 illustrates a bypass circuit 300 in the hot water storage system 100 suitable for implementing the several embodiments of the disclosure. The bypass circuit 300 includes a bypass circuit inlet 302 that receives hot water from the external water heating engine system 202, for example, as opposed to the tank recirculation inlet 118. From the bypass circuit input 302, hot water is supplied to an inlet of a first ball valve 304 and an inlet to a second ball valve 306. An outlet of the ball valve 304 is fluidically coupled to the tank recirculation inlet 118. When the ball valve 304 is open, hot water can flow through the ball valve 304 to the tank recirculation inlet 118. When the ball valve 304 is closed, hot water is fluidically isolated from the tank recirculation inlet 118.

Likewise, an outlet of the ball valve 306 is fluidically coupled to a bypass circuit outlet 310. When the ball valve 306 is open, hot water can flow through the ball valve 306 to the bypass circuit outlet 310. When the ball valve 306 is closed, hot water is fluidically isolated from flowing from the outlet of the ball valve 306 to the bypass circuit outlet 310.

The bypass circuit 300 also includes a ball valve 308 with an inlet fluidically coupled to the hot water outlet 110 of the storage tank 101. An outlet of the ball valve 308 is fluidically coupled to the bypass circuit outlet 310. When the ball valve 308 is open, hot water can flow from the hot water outlet 110 through the ball valve 308 to the bypass circuit outlet 310. When the ball valve 308 is closed, hot water is fluidically isolated from flowing from the hot water outlet 110 to the bypass circuit outlet 310.

In use, the bypass circuit 300 has a normal configuration and a bypass configuration. In the normal configuration, the ball valves 304 and 308 are open and the ball valve 306 is closed. Flow of hot water passes through the ball valves 304 and 308 as described above to supply hot water to the bypass circuit outlet 310. In the bypass configuration, the ball valves 304 and 308 are closed and the ball valve 306 is open. Accordingly, hot water supplied from the external water heating engine system 202 is directly provided to the bypass circuit outlet 310. In effect, the bypass configuration causes the hot water supply system 200 to operate as an on-demand system and does not allow for any hot water recover in the storage tank 101.

While ball valves 304, 306, 308 are shown in FIG. 3, any other shut-off or flow direction valves may be used. Additionally, one of ordinary skill in the art will recognize that many equivalent valve or flow control configurations are possible without departing from the spirit and scope of the bypass circuit 300.

Figure 4:
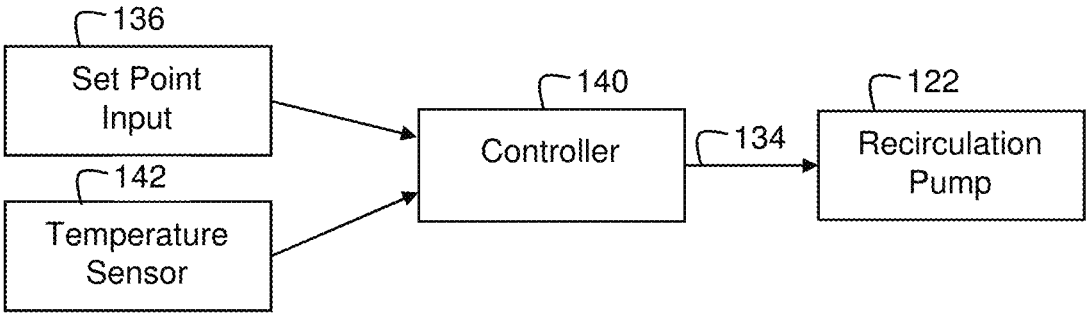
FIG. 4 illustrates a control block diagram of the hot water storage system suitable for implementing the several embodiments of the disclosure.

FIG. 4 illustrates a block diagram of the control block 128 of the hot water storage system 100 suitable for implementing the several embodiments of the disclosure. In some implementations, operation of the control block 128 may be implemented as described in commonly owned U.S. Pat. No. 9,909,780, entitled "System Control for Tank Recovery," hereby incorporated by reference in its entirety.

Briefly, the controller 140 receives the set point input 136, for example from one or more of the heating engines in the external water heating engine system 202. As noted above, the set point input 136 may be received as a temperature reading of how water output by the external water heating system 202 or one of the heating engines therein. Alternatively, the set point input may be supplied by wired or wireless communication with a controller of the external water heating system 202. The controller 140 additionally receives a temperature input from the temperature sensor 142 in the storage tank 101. Upon determining that a difference between the received temperature from the temperature sensor 142 and the set point input exceeds a threshold temperature difference, the controller 140 generates the pump voltage output 134 for powering the recirculation pump 122 and causing the recirculation pump 122 to operate. In various implementations, the recirculation pump 122 continues to operate until the temperature sensor 142 is within a second threshold temperature difference of the set point input. The second threshold temperature difference is less than the threshold temperature difference. For example, the controller 140 may generate the pump voltage output 134 upon a temperature difference of 20° F. from the set point and stop generating the pump voltage output 134 upon the temperature difference being within 5° F. from the set point.

Figure 5:
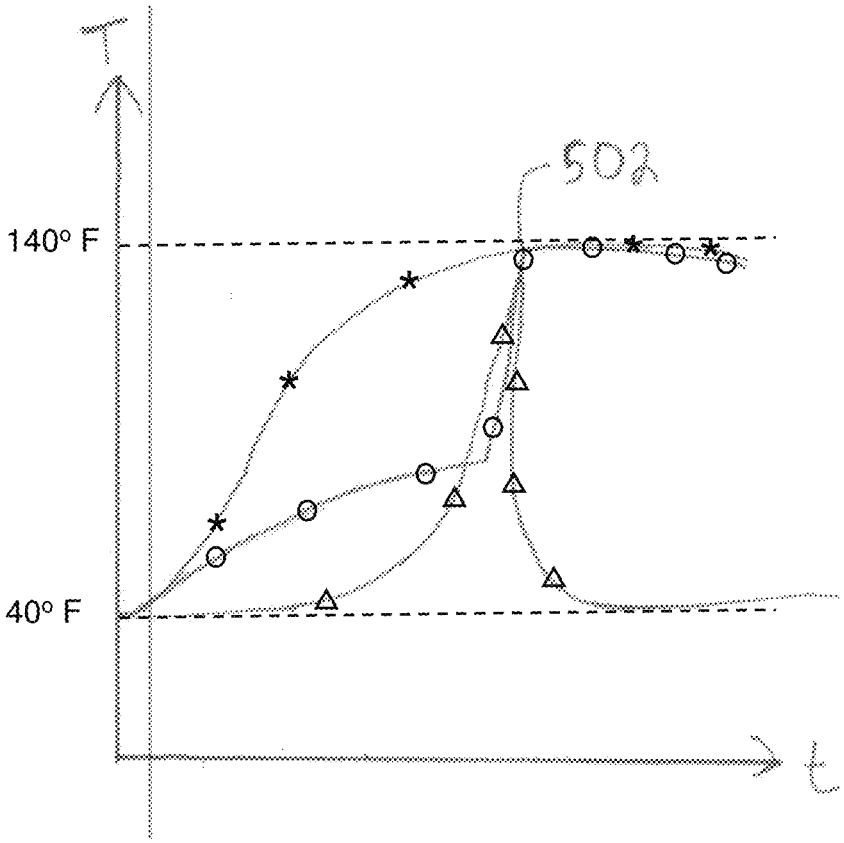
FIG. 5 illustrates a temperature graph of operation of the hot water supply system.

FIG. 5 illustrates a temperature graph of operation of the hot water supply system 200. In the example shown in FIG. 5, the set point is set to 140° F. and the cold-water inlet 108 supplies cold water at 40° F. The inflection point 502 in the graph represents a transition from the hot water supply system 200 operating to recover hot water in the storage tank 101 to operating in response to a demand draw of hot water from the storage tank 101.

A vertical axis in the graph shows a temperature in ° F. and the horizontal axis shows time. The line with a triangle marker indicates a temperature of water at the recirculation outlet 116. The line with a circle marker indicates a temperature of water at the hot water outlet 110. The line with an asterisk marker indicates a temperature of the water at a position farthest from the top surface 102, which may correspond to the location of the temperature sensor 142.

As shown, in the recovery operation, the storage tank 101 fills with hot water recirculating through the recirculation loop from the top surface 102 down towards the bottom surface 104. Additionally, the temperature of water at the hot water outlet 110 is progressively raised through convection.

At the inflection point 502 hot water begins to be drawn out of the top of the storage tank 101 through the hot water outlet 110. As such, the temperature of the hot water outlet 110 jumps to the set point temperature or otherwise the hottest water remaining in the storage tank 101. In the example operation shown in FIG. 5, hot water is drawn out from the storage tank 101 at a rate greater than it can be recovered back into the storage tank 101. In a reverse of the recovery operation, hot water is progressively displaced by cold water at the temperature of the water supplied through the cold-water inlet 108 from the bottom surface 104 up towards the top surface 102. As shown, even when the storage tank 101 is mostly filled with cold water, the hot water storage system 100 maintains stratified temperatures so as to continually provide hot water close to the set point temperature.

Figure 6A:
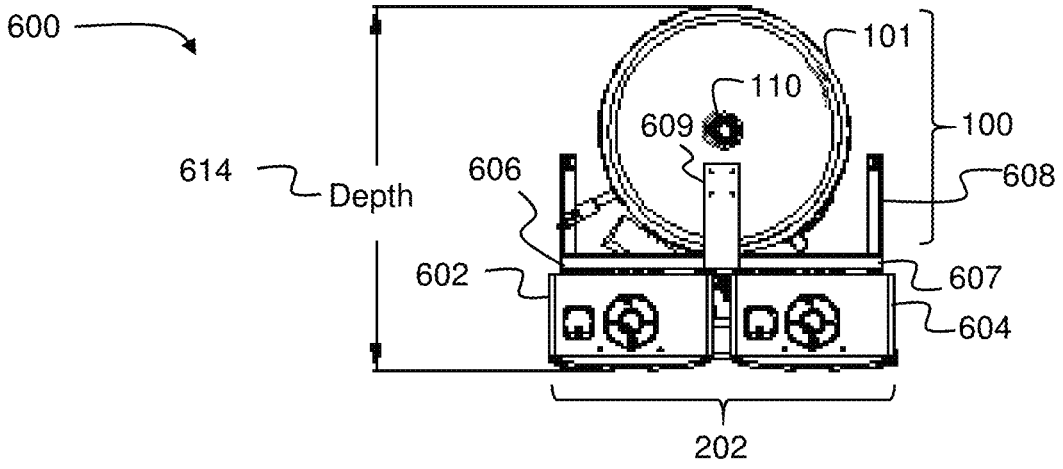
FIGS. 6A and 6B illustrate an implementation of the hot water supply system comprising the hot water storage system and two heating engines on a rack suitable for implementing the several embodiments of the disclosure.
Figure 6B:
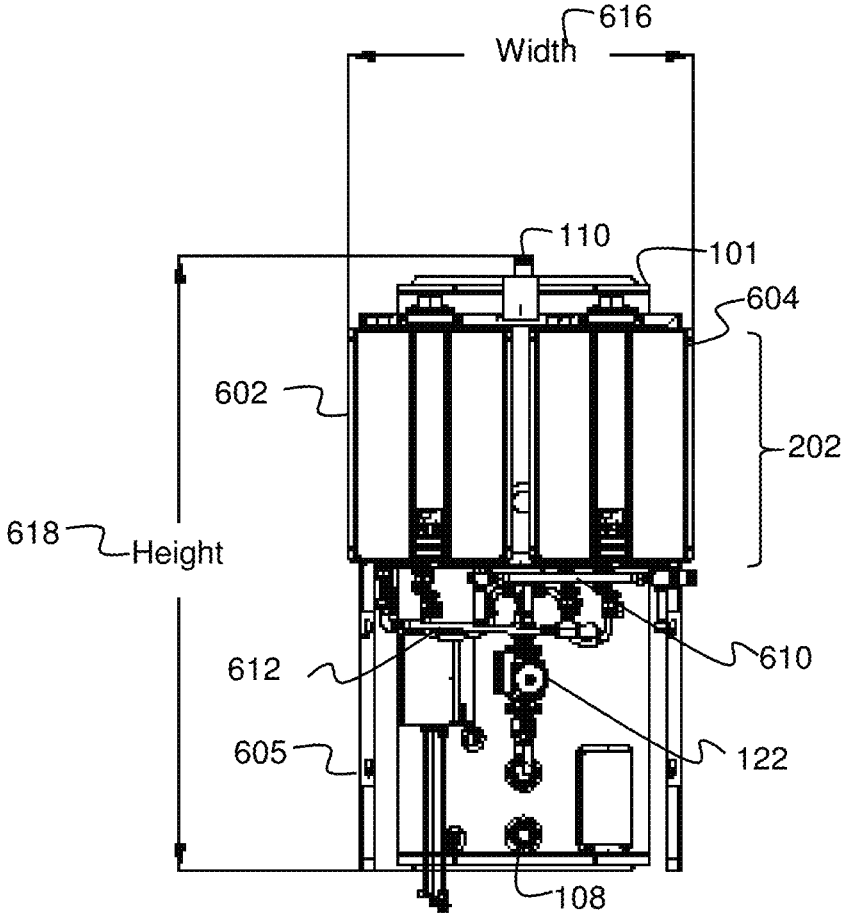

FIGS. 6A and 6B illustrate a top and front view of a hot water supply system 600 comprising the hot water storage system 100 and two heating engines in the external water heating engine system 202. The external water heating system 202 includes a first heating engine 602 and a second heating engine 604. Each of the first and second heating engines 602, 604 are tankless water heaters in the example shown in FIGS. 6A and 6B. The first and second heating engines 602, 604 are mounted to a tankless rack system 606. A surface on which a user interface on one of the first or second heating engines 602, 604 is located is parallel to a plane tangential to a surface of the sidewall 106.

The tankless rack system 606 comprises a plurality of horizontal support legs 608 which rest upon the same substrate or floor as the bottom surface 104 in use. In other words, the support legs 608 are in a plane that is parallel to and coincident with a plane of the bottom surface 104. The support legs 608 are positioned around the tank 101 and cross a plane tangential to a surface of the sidewall 106. A plurality of vertical supports 605 extend perpendicular to the horizontal support legs 608. The vertical supports 605 are arranged to be parallel to the sidewall 106. One or more cross supports 607 extend between the vertical supports 605 perpendicular to both the vertical supports 605 and the support legs 608. A bracket 609 is coupled between one of the cross supports 607 and the top surface 102.

The tankless rack system 606 also comprises a recirculation input manifold 610 fluidically coupled to the storage system recirculation outlet 126. The recirculation input manifold 610 is fluidically coupled to a cold-water input on each of the first and second heating engines 602, 604. Likewise, a hot water output on each of the first and second heating engines 602, 604 is fluidically coupled to a recirculation output manifold 612. The recirculation output manifold 612 is fluidically coupled to the tank recirculation inlet 118 to supply hot water to the storage tank 101.

In the exemplary configuration shown in FIGS. 6A & 6B the hot water supply system 600 provides for a larger capacity hot water system with redundant heating engines in a smaller footprint and overall volume of space than conventional redundant high capacity water heating systems. For example, the hot water supply system 100 includes a 119-gallon tank 101 with a 15 GPM recirculation pump 122. Each of the first and second heating engines 602, 604 are instantaneous water heaters with an input less than 200,000 BTU/hr. In some implementations, the input is greater than 190,000 BTU/hr. While two heating engines are used with the hot water storage system 100, other numbers of heating engines may be used, such as three, four, or five heating engines depending on the capacity requirements of a particular installation.

A depth 614 of the hot water supply system 600 is less than 45 inches. In some implementations, the depth 614 is 41.1 inches. A width 616 of the hot water supply system 600 is less than 80 inches. In some implementations, the width 616 is less than 56.5 inches. In some implementations, the width 616 is 39 inches. A height 618 of the hot water supply system 600 is less than 76.1 inches. In some implementations, the height 618 is 69.6 inches. In some implementations, the hot water system 600 occupies a square footage of less than 16.38 square feet and a total system volume of less than 103.9 cubic feet. For example, the hot water system 600 occupies a square footage of about 11.13 square feet and a total system volume of about 64.5 cubic feet. Accordingly, the hot water system 600 provides for increased capacity while providing redundant heating engines in a smaller floor space than conventional systems. While specific dimensions are provided above, one of ordinary skill in the art will recognize that standard manufacturing tolerances may result in dimensions being within plus or minus of a dimension threshold of the dimensions provided above. In some implementations, the dimension threshold is within plus or minus 0.05% of a given dimension. Other dimension thresholds may be used.

Figure 7:
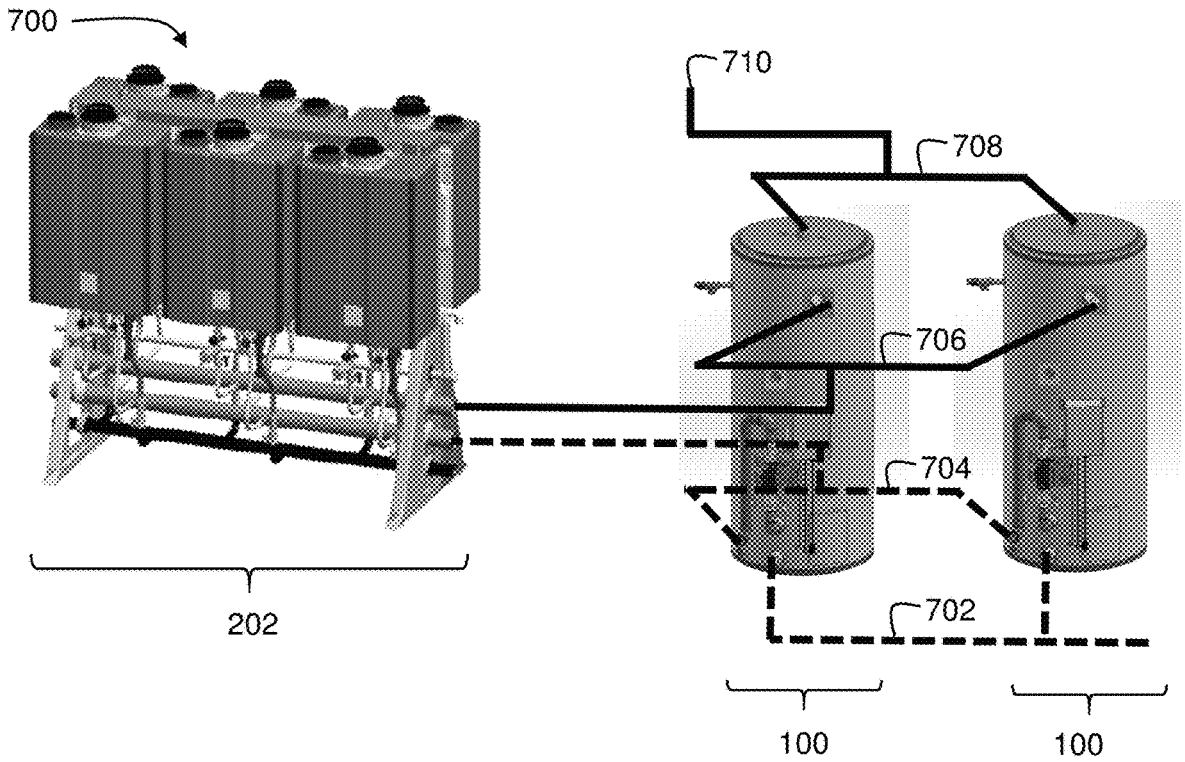
FIG. 7 illustrates an implementation of the hot water supply system comprising two of the hot water storage systems and six heating engines on a rack suitable for implementing the several embodiments of the disclosure.
Figure 8:
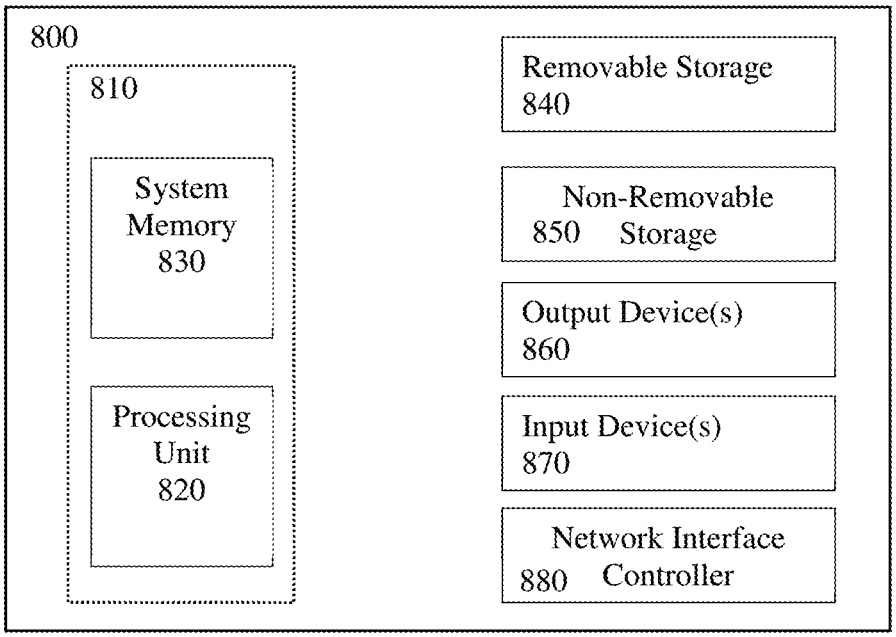
FIG. 8 illustrates an exemplary computer system suitable for implementing the several embodiments of the disclosure.

FIG. 7 illustrates an implementation of a hot water supply system 700 comprising two of the hot water storage systems 100 and six heating engines on a tankless rack system for providing further capacity. Each of the hot water storage systems 100 have their inlets and outlets fluidically coupled together through respective manifolds. For example, the cold-water inlet 108 on each of the hot water storage systems 100 are fluidically coupled together through a cold-water inlet manifold 702.

Likewise, the storage system recirculation outlet 126 on each of the hot water storage systems 100 are fluidically coupled together through a storage system recirculation outlet manifold 704. The storage system recirculation outlet manifold 704 in turn is fluidically coupled to the recirculation input manifold on the tankless rack system of the external water heating engine system 202.

The tank recirculation inlet 118 on each of the hot water storage systems 100 are fluidically coupled together through a tank recirculation inlet manifold 706. The tank recirculation inlet manifold 706 in turn is fluidically coupled to receive hot water from the recirculation output manifold on the tankless rack system of the external water heating engine system 202. The hot water outlet 110 on each of the hot water storage systems 100 are fluidically coupled together through a hot water outlet manifold 708 for supplying hot water to a hot water supply outlet 710.

While the example shown in FIG. 7 includes two hot water storage systems 100 and an external water heating engine system 202 with six tankless water heaters, other numbers of hot water storage systems 100 or heating engines may be used. For example, three hot water storage systems 100 may be used with an external water heating engine system 202 with nine tankless water heaters. Other combinations and configurations may be used.

It should be appreciated that the logical operations described herein with respect to the various figures may be implemented (1) as a sequence of computer implemented acts or program modules (i.e., software) running on a computing device (e.g., the computing device described in FIG. 9), (2) as interconnected machine logic circuits or circuit modules (i.e., hardware) within the computing device and/or (3) a combination of software and hardware of the computing device. Thus, the logical operations discussed herein are not limited to any specific combination of hardware and software. The implementation is a matter of choice dependent on the performance and other requirements of the computing device. Accordingly, the logical operations described herein are referred to variously as operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

Referring to FIG. 9, an example computing device 900 upon which embodiments of the invention may be implemented is illustrated. For example, the controller 140 may be implemented as a computing device, such as computing device 900. It should be understood that the example computing device 900 is only one example of a suitable computing environment upon which embodiments of the invention may be implemented. Optionally, the computing device 900 can be a well-known computing system including, but not limited to, personal computers, servers, handheld or laptop devices, multiprocessor systems, microprocessor-based systems, network personal computers (PCs), minicomputers, mainframe computers, embedded systems, and/or distributed computing environments including a plurality of any of the above systems or devices. Distributed computing environments enable remote computing devices, which are connected to a communication network or other data transmission medium, to perform various tasks. In the distributed computing environment, the program modules, applications, and other data may be stored on local and/or remote computer storage media.

In an embodiment, the computing device 900 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computing device 900 to provide the functionality of a number of servers that is not directly bound to the number of computers in the computing device 900. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third-party provider. Some cloud computing environments may comprise cloud computing resources owned and operated by the enterprise as well as cloud computing resources hired and/or leased from a third-party provider.

In its most basic configuration, computing device 900 typically includes at least one processing unit 920 and system memory 930. Depending on the exact configuration and type of computing device, system memory 930 may be volatile (such as random-access memory (RAM)), non-volatile (such as read-only memory (ROM), flash memory, etc.), or some combination of the two. This most basic configuration is illustrated in FIG. 9 by dashed line 910. The processing unit 920 may be a standard programmable processor that performs arithmetic and logic operations necessary for operation of the computing device 900. While only one processing unit 920 is shown, multiple processors may be present. Thus, while instructions may be discussed as executed by a processor, the instructions may be executed simultaneously, serially, or otherwise executed by one or multiple processors. The computing device 900 may also include a bus or other communication mechanism for communicating information among various components of the computing device 900.

Computing device 900 may have additional features/functionality. For example, computing device 900 may include additional storage such as removable storage 940 and non-removable storage 950 including, but not limited to, magnetic or optical disks or tapes. Computing device 900 may also contain network connection(s) 980 that allow the device to communicate with other devices such as over the communication pathways described herein. The network connection(s) 980 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. Computing device 900 may also have input device(s) 970 such as keyboards, keypads, switches, dials, mice, track balls, touch screens, voice recognizers, card readers, paper tape readers, or other well-known input devices. Output device(s) 960 such as printers, video monitors, liquid crystal displays (LCDs), touch screen displays, displays, speakers, etc. may also be included. The additional devices may be connected to the bus to facilitate communication of data among the components of the computing device 900. All these devices are well known in the art and need not be discussed at length here.

The processing unit 920 may be configured to execute program code encoded in tangible, computer-readable media. Tangible, computer-readable media refers to any media that is capable of providing data that causes the computing device 900 (i.e., a machine) to operate in a particular fashion. Various computer-readable media may be utilized to provide instructions to the processing unit 920 for execution. Example tangible, computer-readable media may include, but is not limited to, volatile media, non-volatile media, removable media and non-removable media implemented in any method or technology for storage of information such as computer readable instructions, data structures, program modules or other data. System memory 930, removable storage 940, and non-removable storage 950 are all examples of tangible, computer storage media. Example tangible, computer-readable recording media include, but are not limited to, an integrated circuit (e.g., field-programmable gate array or application-specific IC), a hard disk, an optical disk, a magneto-optical disk, a floppy disk, a magnetic tape, a holographic storage medium, a solid-state device, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices.

It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

In an example implementation, the processing unit 920 may execute program code stored in the system memory 930. For example, the bus may carry data to the system memory 930, from which the processing unit 920 receives and executes instructions. The data received by the system memory 930 may optionally be stored on the removable storage 940 or the non-removable storage 950 before or after execution by the processing unit 920.

The various techniques described herein may be implemented in connection with hardware or software or, where appropriate, with a combination thereof. Thus, the methods and apparatuses of the presently disclosed subject matter, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computing device, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., using an application programming interface (API), reusable controls, or the like. Such programs may be implemented in a high level procedural or object-oriented programming language to communicate with a computer system. However, the program(s) can be implemented in assembly or machine language, if desired. In any case, the language may be a compiled or interpreted language and it may be combined with hardware implementations.

Embodiments of the methods and systems may be described herein with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general-purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

While several embodiments have been provided in the present disclosure, the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A hot water storage system, comprising:

a storage tank with a top surface, a bottom surface, and a sidewall that extends between the top surface and the bottom surface, the storage tank encloses a volume;

a tank cold water inlet;

a tank recirculation outlet positioned on the sidewall above the tank cold water inlet;

a tank recirculation inlet positioned on the sidewall above the tank recirculation outlet;

a storage system recirculation outlet;

a recirculation pump positioned between the tank recirculation outlet and the storage system recirculation outlet, the recirculation pump comprising a pump inlet and a pump outlet; and an inlet isolation valve positioned between the tank recirculation outlet and the pump inlet, wherein the pump inlet is in fluid communication with the tank recirculation outlet when the inlet isolation valve is open, and wherein the pump inlet is fluidically isolated from the tank recirculation outlet when the inlet isolation valve is closed.

2. The hot water storage system of claim 1, further comprising:

an outlet isolation valve positioned between the pump outlet and the storage system recirculation outlet, wherein the storage system recirculation outlet is in fluid communication with the pump outlet when the outlet isolation valve is open, and wherein the storage system outlet is fluidically isolated from the pump outlet when the outlet isolation valve is closed.

3. The hot water storage system of claim 1, wherein the cold-water inlet is positioned on the sidewall about the bottom surface.

4. The hot water storage system of claim 1, further comprising:

a tank hot water outlet positioned on the top surface;

a storage system hot water outlet; and a second outlet isolation valve positioned between the tank hot water outlet and the storage system hot water outlet, wherein the storage system hot water outlet is in fluid communication with the tank hot water outlet when the second outlet isolation valve is open, and wherein the storage system hot water outlet is fluidically isolated from the tank hot water outlet when the second outlet isolation valve is closed.

5. The hot water storage system of claim 4, further comprising:

a storage system recirculation inlet; and a second inlet isolation valve positioned between the storage system recirculation inlet and the storage system hot water outlet, wherein the storage system hot water outlet is in fluid communication with the storage system recirculation inlet when the second inlet isolation valve is open, and wherein the storage system hot water outlet is fluidically isolated from the storage system recirculation inlet when the second inlet isolation valve is closed.

6. The hot water storage system of claim 5, further comprising:

a third inlet isolation valve positioned between the storage system recirculation inlet and the tank recirculation inlet, wherein the tank recirculation inlet is in fluid communication with the storage system recirculation inlet when the third inlet isolation valve is open, and wherein the storage system hot water outlet is fluidically isolated from the storage system recirculation inlet when the outlet isolation valve is closed.

7. The hot water storage system of claim 1, further comprising:

a temperature sensor positioned within the volume about the recirculation water outlet; and a controller in communication with the temperature sensor and configured to receive a first input of a temperature from the temperature sensor, the controller further configured to receive a second input of a set point wherein the controller is configured to activate the recirculation pump based on the set point and the temperature.

8. The hot water storage system of claim 7, wherein the second input is a communication of the set point received from an external control system.

9. The hot water storage system of claim 7, further comprising:

a second temperature sensor configured to measure a temperature of hot water supplied to the recirculation water inlet, wherein the second input is the temperature from the second temperature sensor.

10. The hot water storage system of claim 1, wherein the tank recirculation inlet positioned along the sidewall at or above at least at 80% of the volume from the bottom surface.

11. The hot water storage system of claim 10, wherein the tank recirculation outlet is positioned along the sidewall at or below at least 20% of the volume from the bottom surface.

12. A hot water supply system, comprising:

a plurality of hot water heaters, each comprising a heater inlet and a heater outlet, wherein the heater inlet is coupled to an inlet manifold and the heater outlet is coupled to an outlet manifold;

a storage tank with a top surface, a bottom surface, and a sidewall that extends between the top surface and the bottom surface, the storage tank encloses a volume;

a tank recirculation outlet positioned on the sidewall;

a recirculation pump positioned between the tank recirculation outlet and the inlet manifold; and a tank recirculation inlet positioned on the sidewall above the tank recirculation outlet and coupled to the outlet manifold.

13. The hot water supply system of claim 12, wherein the plurality of hot water heaters are tankless water heaters.

14. The hot water supply system of claim 13, wherein each of the plurality of tankless water heaters has an input of less than 200,000 BTU/hr.

15. The hot water supply system of claim 14, wherein the storage tank has a capacity of 119 gallons.

16. The hot water supply system of claim 15, wherein a floor space coverage of less than 16.38 square feet.

17. The hot water supply system of claim 16, wherein a total volume of the hot water supply system is less than 103.9 cubic feet.

18. The hot water supply system of claim 13, further comprising:

a second storage tank with a second top surface, a second bottom surface, and a second sidewall that extends between the second top surface and the second bottom surface, the second storage tank encloses a second volume;

a second tank recirculation outlet positioned on the second sidewall; and a tank recirculation outlet manifold coupled to the tank recirculation outlet and the second tank recirculation outlet, wherein the tank recirculation outlet manifold is further coupled to the inlet manifold.

19. The hot water supply system of claim 18, further comprising:

a second tank recirculation inlet positioned on the second sidewall above the second tank recirculation outlet; and a tank recirculation inlet manifold coupled to the tank recirculation inlet and the second tank recirculation inlet, wherein the tank recirculation inlet manifold is further coupled to the outlet manifold.

* * * * *